United States Patent [19]

Penhasi

[11] Patent Number: 4,822,330

[45] Date of Patent: Apr. 18, 1989

[54] ROTOR WITH STRESS RELIEF

[75] Inventor: Harry A. Penhasi, Cupertino, Calif.

[73] Assignee: Beckman Instruments, Inc., Fullerton, Calif.

[21] Appl. No.: 115,480

[22] Filed: Oct. 30, 1987

[51] Int. Cl.[4] ..... B04B 5/02

[52] U.S. Cl. ..... 494/16; 494/43; 494/84

[58] Field of Search ..... 494/16–21, 494/10, 81, 84, 85, 45, 65, 27, 37

[56] References Cited

U.S. PATENT DOCUMENTS

| | | | |
|---|---|---|---|
| 4,254,904 | 3/1981 | Ostermeyer et al. | 494/36 X |
| 4,350,282 | 9/1982 | Dudrey et al. | 494/49 |
| 4,350,283 | 9/1982 | Leonian | 494/10 |
| 4,701,157 | 10/1987 | Potter | 494/16 |

*Primary Examiner*—Timothy F. Simone
*Attorney, Agent, or Firm*—William H. May; Paul R. Harder

[57] ABSTRACT

The present invention provides a mechanism for bolting a rotor to a hub without introducing excessive radial stress around the bolt holes when the rotor is operating at high speed. The rotor has a slot cut through its center to eliminate radial stress perpendicular to the slot and thereby avoid the problem of stress cracking of the otherwise weak section. The mounting bolts are necked down and not threaded at the surface of the hub. The bolts are threaded into the hub at a substantial distance from the top surface of the hub so that they can flex and so that the center of the rotor can move out relative to the hub. The hub rotor interface is lubricated to facilitate radial motion of the center of the rotor.

8 Claims, 2 Drawing Sheets

ROTOR WITH STRESS RELIEF

TECHNICAL FIELD

The present invention related to centrifuges and more particularly to rotors for centrifuges.

BACKGROUND AND PRIOR ART

If a circular disk is rotated at high speed (for example, 50 thousand RPM) the disk will expand radially. If the disk has a hole in the center to accommodate a drive shaft, high speed rotation will cause the center hole to expand. The expansion of the center hole of the disk results in stresses distributed around the hole in the center of the disk.

In many centrifuges, the rotor is bolted to a hub which is in turn driven by a spindle or shaft. If a rotor is bolted to a hub, the bolt holes create both radial and tangential stress patterns. The bolts not only hold the rotor down and gives it tangential force necessary to cause rotation, but they also constrain the center portion of the rotor from moving outward as the centrifugal forces expand the radius of the rotor. This introduces additional stresses into the rotor, particularly around the bolt holes.

In the prior art this problem was addressed by providing a substantially solid hub which was reinforced as required to tolerate the centrifugal stresses generated with neglible strain at the hub, thus allowing for a rigid assembly and concentricity as required for dynamic stability. In many instances the problem was addressed by a combination of making the rotor strong enough to withstand the stress by reducing strain and by removing material from the rotor to reduce the centrifugal forces. For example in the device shown in U.S. Pat. No. 4.350.283 (Leonian) the material has been removed to the extent that the rotor essentially consists of a bar which has a disk under the bar to impart stability to the structure.

Another factor that introduces stress points into a rotor is that rotors generally include tubes that interconnect the separation chamber. Space for these tubes could be provided by having a hole through the disk or by having a slot cut partway through the rotor. Such discontinuities in a rotor introduce further stresses because the portion of the disk with the hole or slot tends to expand at one rate whereas the other portion of the rotor expands at a different rate and hence, in addition to the tangential and radial forces, bending forces are introduced into the rotor resulting in complex stress distribution patterns.

Stress analysis techniques are well known: however, two dimensional stress analysis as applied to a substantially symmetrical design is a much faster operation than is three dimensional stress analysis. Rotors which have asymmetrical features such as holes and openings to facilitate tubing generally require a time consuming three dimensional analysis process followed by complex solutions.

OBJECTS OF THE INVENTION

An object of the present invention is to provide an improved rotor for a centrifuge.

A further object of the invention is to provide a centrifuge where the stress at the center of the rotor has been reduced.

Yet another object of the present invention is to provide an improved rotor which is bolted to a hub without introducing excessive radial stress surrounding the bolt holes.

Still another object of the present invention is to provide an improved technique for connecting a rotor to a drive hub.

A still further object of the invention is to provide a rotor which can easily be designed using simple two dimensional stress analysis techniques.

SUMMARY OF THE INVENTION

The present invention provides a mechanism for bolting a rotor to a hub without introducing excessive radial stress around the bolt holes when the rotor is operating at high speed. The rotor has a slot cut through its center to eliminate radial stress perpendicular to the slot and thereby eliminating the problem of stress cracking at the otherwise weak section. The mounting bolts are necked down and not threaded at the surface of the hub. The bolts are threaded into the hub at a substantial distance from the top surface of the hub so that they can flex and so that the center of the rotor can move out relative to the hub. The hub rotor interface is lubricated to facilitate radial motion of the center of the rotor.

DETAILED DESCRIPTION OF AN EMBODIMENT OF THE INVENTION

Figure 1:
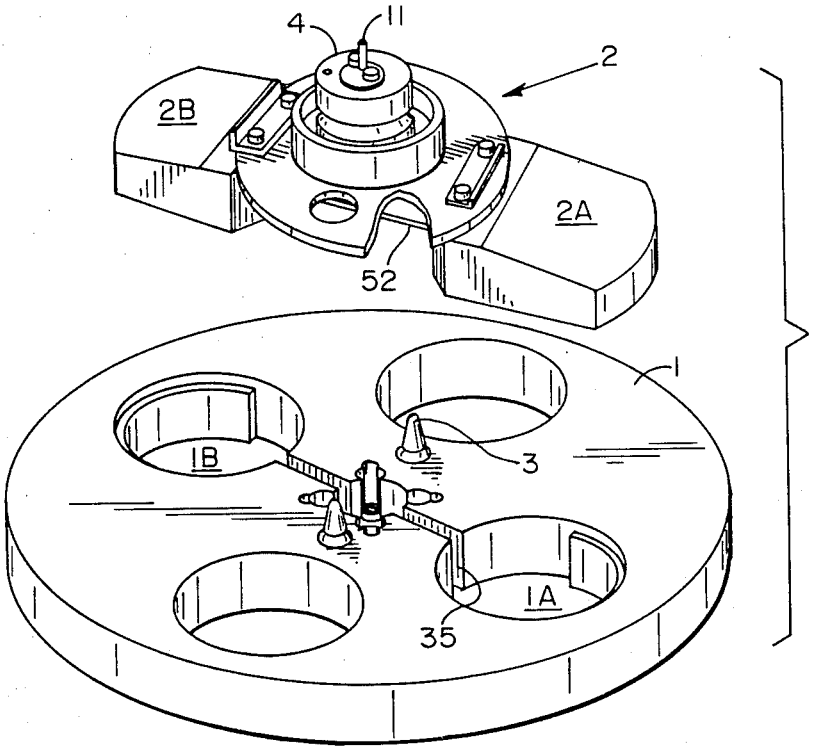
FIG. 1 is an overall perspective view of an embodiment of the present invention.

An overall view of a preferred embodiment of the invention is shown in FIG. 1. The separation chamber assembly 2 can be removably mounted on disk 1 using retaining mechanism 3. Separation chambers 2A and 2B fit into holes 1A and 1B which are cut into disk 1. Fluid flows to and from chambers 2A and 2B via inlet port 11 and rotating seal 4. Tubing 520 interconnects the separation chambers 2A and 2B.

The details of the separation chamber assembly 2, the retaining mechanism 3, and the manner of supplying fluid to the separation chambers 2A and 2B are not relevant to the present invention. These elements are described in more detail in copending application SER. NO. 115,217 which was filed the same day as the present invention. The description in copending application Ser. No. 115,217 is hereby incorporated herein by reference.

In order to give an understanding of the size and weights involved, the following typical specifications for disk 1 are given. Disk 1 is constructed from aluminum plate. The rotor diameter is 16 and ½ inches, the thickness is 2 inches and it weights 33 pounds. The thickness between the outside edge of holes 1A to 1D and the periphery of the rotor is 1 and ¼ inches. The holes 1A and 1B have a diameter of 5 inches and holes 1C and 1D have a diameter of 4 inches. Naturally it should be understood that these are merely the dimensions of one particular embodiment of the invention and that other dimensions could be used without departing from the spirit or scope of the invention.

Figure 2:
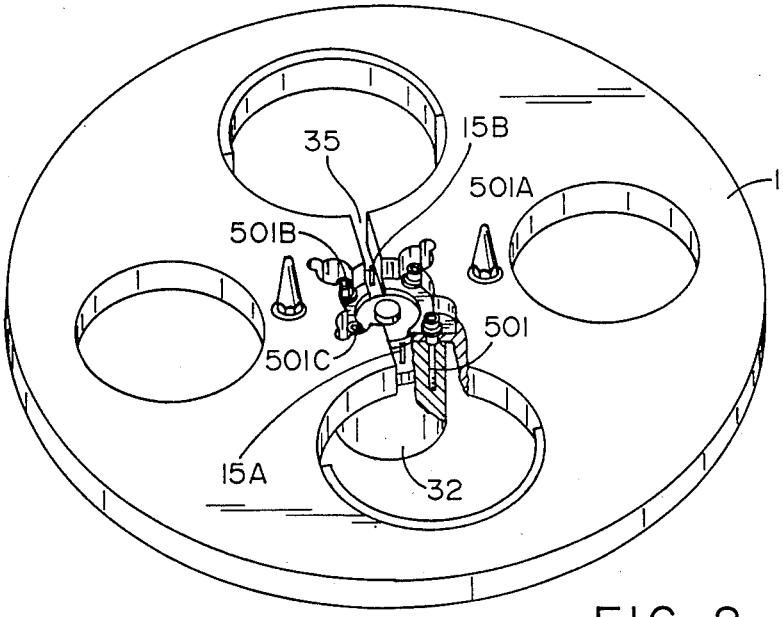
FIG. 2 is a cut away view showing the bolts that hold the rotor to the hub.

As shown in FIG. 2 disk 1 is attached to the hub 32 by means of bolt 501 and a spring washer 502. Bolt 501 is cut necked down and only threaded at end portion 501A. The interface surface 503 which is located between disk 1 and hub 32 is coated with the a conventional low friction non-galling lubricating material.

Because of the spring action provided by the necked down portion of bolts 501, disk 1 can move relative to the surface of the hub 32 at the interface 503. In the embodiment shown, bolt 501 is a one quarter inch bolt, two and a half inches long, displacements in the order or twenty thousandths of an inch are typical. A typical torque value for the bolts is 60 inch pounds. An example of a low friction interface material 503 which can be used is a plastic sheet or Microseal 100-1 which is graphite based and which is commercially available.

The center portion of the surface of disk 1 moves radially more than the surface of hub 32 because the disk 1 has a wider radius than does hub 32. Furthermore hub 32 is thicker than disk 1 and hence it can withstand more force without expanding.

Pins 15A and 15B fit in slot 35 and transfer tangential force from hub 32 to disk 1. Pins 15A and 15B have a sliding fit to the sides of slot 35, hence they do not transmit any radial force to the disk.

Slot 35 provides a passageway for tubes 520. Tubes 520 could fit in a passageway or groove that was not cut all the way through disk 1; however, if such a groove were cut in the top of disk 1, there would be shearing or bending stresses in the disk when it rotates. The stress analysis of such a disk would be a three dimensional problem. Slot 35 which is cut all the way through the disk 1 reduces the stress analysis problem from a three dimensional problem to a two dimensional problem. A two dimensional stress analysis of disk 1 requires about one week's effort. A three dimensional stress analysis requires several times that effort, typically followed by a complex solution. Reduction of the time required to do a stress analysis significantly reduces the cost of engineering a rotor and yields a simpler design, hence, significantly reducing the ultimate cost of the rotor.

If slot 35 were only cut deep enough to allow the space required by tubes 520, the disk would tend to rupture along the slot after use, thereby reducing the useful life of the disk.

Clamping mechanism 3 holds the separation chamber assembly 2 in position in the disk 1. Holding mechanism 3 does not apply any radial or tangential force to the assembly 2. All radial and tangential forces are applied to assembly 2 by the walls of the openings 1A and 1B. The operation of holding device 3 is explained more fully in copending application Ser. No. 115,217 the description of which is hereby incorporated herein by reference.

Hub 32 is mounted on the spindle or drive shaft of a conventional centrifuge (not shown). An example of a commercially available centrifuge whereon hub 32 can be mounted is the standard J-6 floor model refrigerated centrifuge commercially available from Beckman Instruments Corporation, Spinco Division, Palo Alto, CA.

Slot 35 in disk 1 allows the center of the disk to expand in a direction perpendicular to the center of slot 35. This embodiment shows only one slot 35; however, there could be a second slot perpendicular to slot 35 to relieve the stress along that line also.

Figure 3:
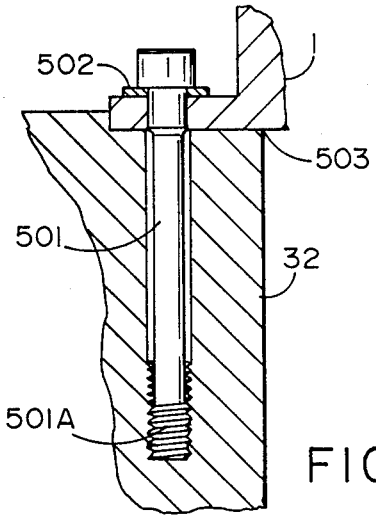
FIG. 3 is a side view of the mounting bolts.

FIG. 3 shows bolt 501 in detail. It should be understood that there are four identical bolts that hold disk 1 to hub 32. Three of the bolts are designated 501, 501A and 501B. A fourth bolt is located in hole 501C.

While the invention has been particularly shown and described with reference to a preferred embodiment thereof, it will be understood by those skilled in the art that the previously explained and other changes in the form and detail of the embodiment may be made without departing from the spirit and scope of the invention.

I claim:

1. A rotor for a centrifuge comprising in combination:

a disk having flat bottom surfaces, hub means for attaching said disk to the spindle of a centrifuge, said hub having a mated and correspondingly flat top surface, said flat bottom surface of said disk being positioned next to said flat top surface of said hub to form an interface for relative movement between said hub and disk upon loading due to centrifugation, bolt means passing through said disk into said hub, said bolt means having an elastic portion and threads at the end thereof and said hub means has bolt holes which dispose at least one end of said bolt at a substantial distance from the interface for relative movement between said hub and disk, whereby said bolt means act as springs allowing said disk to move radially with respect to said hub at said interface, said bolt means maintaining pressure between said top surface of said hub and said bottom surface of said disk in a direction perpendicular to the flat top surface of said hub but allowing radial motion of said disk surface relative to the surface of said hub, whereby said surface of said disk can move radially relative to said surface of said hub during dynamic loading due to centrifugation.

2. A rotor for a centrifuge comprising in combination:

a disk having a flat bottom surface and a plurality of openings positioned along a diameter of said disk, a channel through the center of said disk interconnecting said openings, whereby said disk can sustain no stress at its center in a direction perpendicular to said channel, hub means for attaching said disk to the spindle of a centrifuge, said hub having a flat top surface, said bottom surface of said disk being positioned next to said top surface of said hub to form an interface for relative movement between said hub and disk upon loading due to centrifugation, bolt means passing through said disk into said hub, said bolt means having an elastic portion and threads at the end thereof and said hub means has bolt holes which dispose at least one end of said bolt at a substantial distance from the interface for relative movement between said hub and disk, whereby said bolt means act as springs allowing said disk to move radially with respect to said hub at said interface, said bolt means maintaining pressure between said top surface of said hub and said bottom surface of said disk in a direction perpendicular to the flat top surface of said hub but allowing radial motion of said disk surface relative to the surface of said hub, whereby said surface of said disk can move radially relative to said surface of said hub during dynamic loading due to centrifugation.

3. The combination recited in claim 2 wherein the interface for relative movement between said hub and disk is lubricated to facilitate radial motion of the center of said disk.

4. The combination recited in claim 2 wherein said bolt means have a necked down center portion and threads at the end thereof and said hub means has bolt holes which only have threads at a substantial distance from the top surface of said hub. whereby said bolt means act as springs allowing said disk to move radially.

5. A rotor assembly for a centrifuge which has at least one separation chamber comprising in combination, hub means for attaching said assembly to a spindle, said hub means having a flat surface for confrontation to disk means, a disk means for supporting said separation chamber, said disk means having a lower flat surface for confrontation to a hub means whereby said confronted disk means and hub means form an interface for relative movement between said hub means and said disk means;

said disk means defining a plurality of openings positioned along a diameter of said disk;

said disk means further defining a radially extending channel through the center of said disk interconnection said defined openings whereby said disk can sustain no stress at its center in a direction perpendicular to said channel;

pins means attached to said hub means and protruding to said disk means at said defined channel, said pin means configured for sliding movement along said radially extending channel whereby said pin means does not apply stress to said disk means upon radial relative movement of said disk with respect to said channel yet transfer torque from said hub means to said disk means upon rotation of said hub means;

bolt means passing through said disk into said hub means, said bolt means having an elastic portion and threads at the end thereof and said hub means has bolt holes which dispose at least one end of said bolt at a substantial distance from the interface for relative movement between said hub means and said disk means whereby said bolt means act as springs allowing said disk means to move radially with respect to said hub means responsive to dynamic loading due to centrifugation;

whereby the center of said disk is allowed to expand relative to said surface of said hub.

6. The combination recited in claim 5 wherein said disk has a plurality of openings along a diameter thereof.

a slot connecting said openings whereby said the center of said disk can expand in a direction perpendicular to said slot.

7. The combination recited in claim 6 wherein said rotor has a first separation chamber and a second separation chamber.

8. The combination recited in claim 7 wherein said first and second separation chambers are connected in series by a tube positioned in said slot.

* * * * *